US005182818A

United States Patent [19]

Nawoj

[11] Patent Number: 5,182,818

[45] Date of Patent: Feb. 2, 1993

[54] CHILD COMMODE SEAT APPARATUS

[76] Inventor: John P. Nawoj, 153 Main St., Sayreville, N.J. 08872

[21] Appl. No.: 740,710

[22] Filed: Aug. 6, 1991

[51] Int. Cl.[5] ..... A47K 13/00

[52] U.S. Cl. ..... 4/235

[58] Field of Search ..... 4/235, 239, DIG. 5

[56] References Cited

U.S. PATENT DOCUMENTS

| | | | |
|---|---|---|---|
| 932,442 | 8/1909 | Cagle | 4/DIG. 5 X |
| 1,848,443 | 3/1932 | Toops | 4/DIG. 5 X |
| 1,867,674 | 7/1932 | McCandless | 4/DIG. 5 X |
| 2,073,390 | 3/1937 | Giblette | 4/DIG. 5 X |
| 2,100,774 | 11/1937 | DePuy et al. | 4/DIG. 5 X |
| 4,516,279 | 5/1985 | Block | 4/239 X |

*Primary Examiner*—Charles E. Phillips
*Attorney, Agent, or Firm*—Leon Gilden

[57] ABSTRACT

A child commode seat is positioned for mounting and pivotment relative to a top surface of a commode bowl oriented interiorly and concentrically thereof, with the commode seat including a removable urine splash shield. The splash shield includes a plurality of inserts secured to the splash shield to enhance deflection of fluid spray relative to the shield.

2 Claims, 4 Drawing Sheets

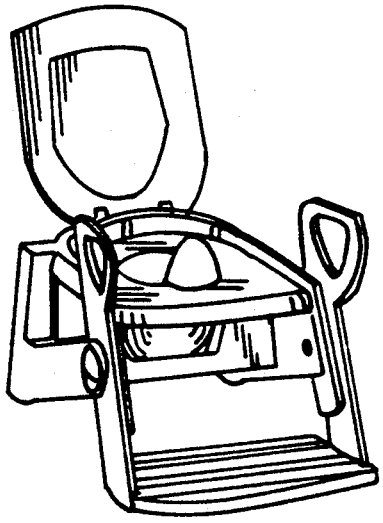
FIG 1
PRIOR ART
FIG 2
PRIOR ART
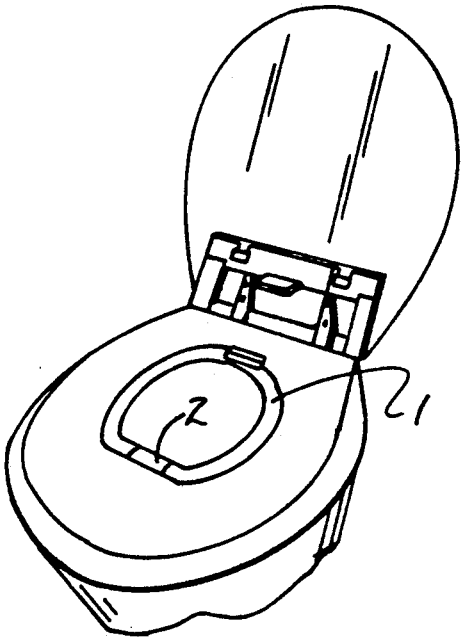

CHILD COMMODE SEAT APPARATUS

BACKGROUND OF THE INVENTION

1. Field of the Invention

The field of invention relates to commode apparatus, and more particularly pertains to a new and improved child commode seat apparatus wherein the same is arranged for the accommodation and toilet training of small children.

2. Description of the prior Art

Various commode seat constructions are utilized in the prior art for use with children, such as exemplified in U.S. Pat. No. 4,516,279 to Block wherein a child's training seat is mounted interiorly of a commode lid utilizing a splash shield mounted thereto.

U S. Pat. No. 4,777,672 to Gebhard, et al. wherein a child's toilet apparatus of unitary construction utilizes a splash shield member secured thereto U.S. Pat. No. 4,638,514 to Landsberger sets forth a superimposed toilet seat to include mounting to a conventional toilet seat structure.

As such, it may be appreciated that there continues to be a need for a new and improved child commode seat apparatus as set forth by the instant invention which addresses both the problems of ease of use as well as effectiveness in construction in the training and proper orientation of a child in the use of a toilet structure and in this respect, the present invention substantially fulfills this need.

SUMMARY OF THE INVENTION

In view of the foregoing disadvantages inherent in the known types of commode apparatus now present in the prior art, the present invention provides a child commode seat apparatus wherein the same is mounted interiorly of a commode seat mounted to a top surface of a commode for the positioning and training of a child in its use. As such, the general purpose of the present invention, which will be described subsequently in greater detail, is to provide a new and improved child commode seat apparatus which has all the advantages of the prior art commode apparatus and none of the disadvantages.

To attain this, the present invention provides a child commode seat positioned for mounting and pivotment relative to a top surface of a commode bowl oriented interiorly and concentrically thereof, with the commode seat including a removable urine splash shield. The splash shield includes a plurality of inserts secured to the splash shield to enhance deflection of fluid spray relative to the shield.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the resent invention to provide a new and improved child commode seat apparatus which has all the advantages of the prior art child commode seat apparatus and none of the disadvantages.

It is another object of the present invention to provide a new and improved child commode seat apparatus which may be easily and efficiently manufactured and marketed.

It is a further object of the present invention to provide a new and improved child commode seat apparatus which is of a durable and reliable construction.

An even further object of the present invention is to provide a new and improved child commode seat apparatus which is susceptible of a low cost of manufacture with regard to both materials and labor, and which accordingly is then susceptible of low prices of sale to the consuming public, thereby making such child commode seat apparatus economically available to the buying public.

Still yet another object of the present invention is to provide a new and improved child commode seat apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art child's commode seat.

FIG. 2 is an isometric illustration of a further example of child's commode seat structure.

DESCRIPTION OF THE PREFERRED EMBODIMENT

Figure 3:
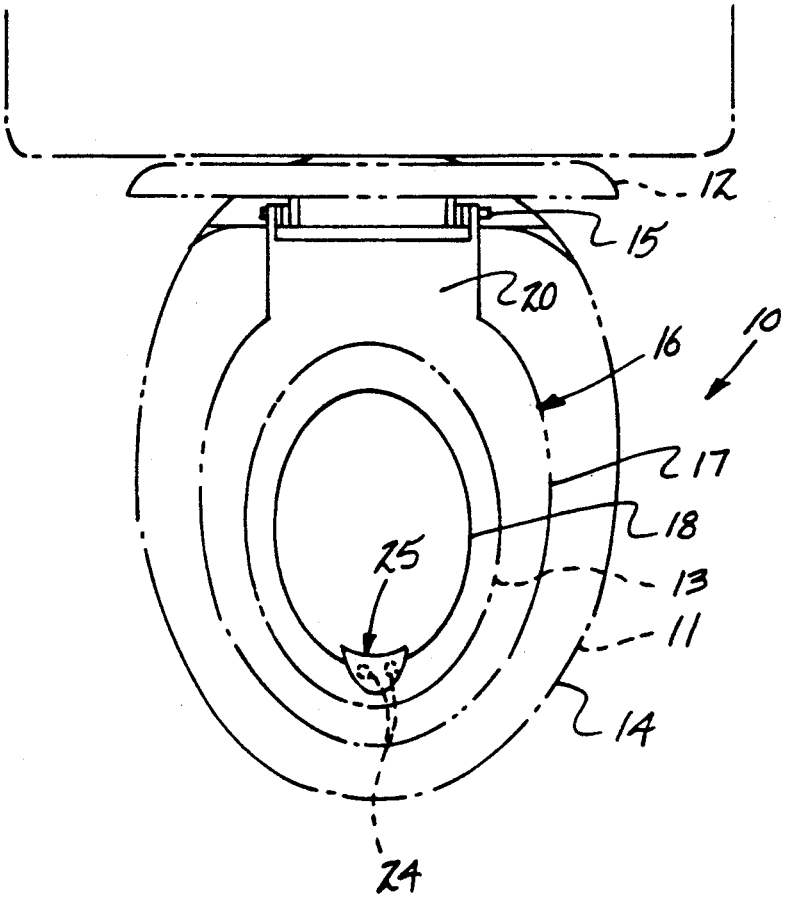
FIG. 3 is a top orthographic view of the instant invention.
Figure 4:
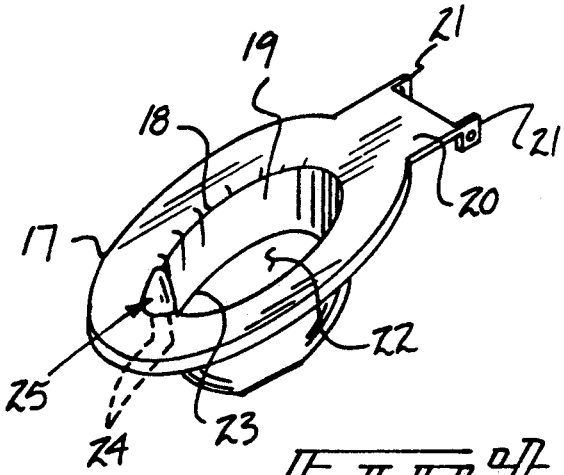
FIG. 4 is an isometric illustration of the insert utilized by the invention.
Figure 5:
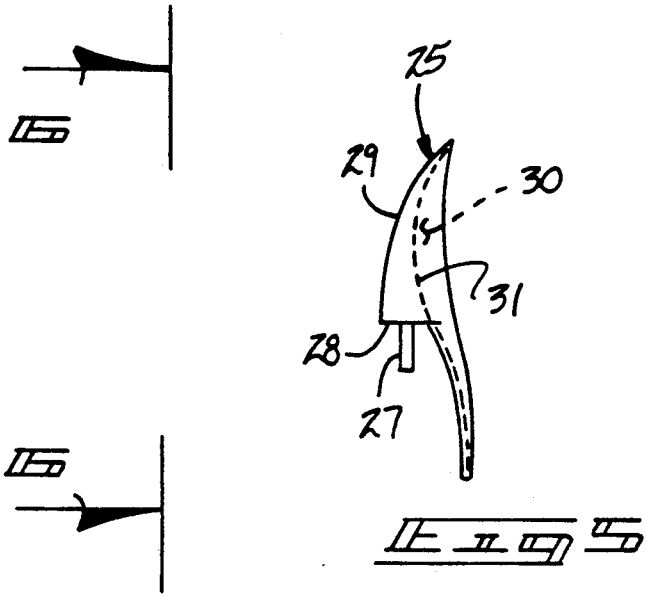
FIG. 5 is an orthographic side view of the splash shield utilized by the invention.
Figure 6:
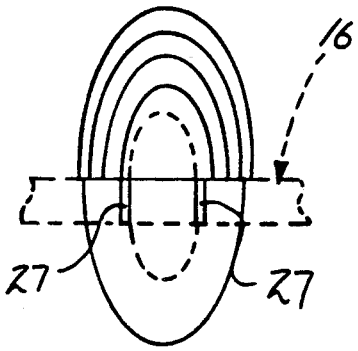
FIG. 6 is an orthographic view, taken along the lines 6—6 of FIG. 5 in the direction indicated by the arrows.

With reference now to the drawings, and in particular to FIGS. 3 to 11 thereof, a new and improved child commode seat apparatus embodying the principles and concepts of the present invention and generally designated by the reference numeral 10 will be described.

FIGS. 1 and 2 illustrate prior art infant commode seat structure, as presented in the U.S. Pat. Nos. 4,777,672 and 4,516,279 respectively. The patents each show examples of prior art commode seat structure, with the prior art of FIG. 2 illustrating a flip-up splash shield member 2 mounted within the insert 1.

More specifically, the child commode seat apparatus 10 of the instant invention essentially comprises a combination with a commode seat 11 mounted to a top surface of a conventional commode, wherein the commode seat 11 includes a commode lid 12 hingedly mounted to the commode seat. The commode includes a commode outer continuous edge 14 spaced from a commode inner continuous edge 13, with the commode seat including a child's insert seat 16 mounted between the inner and outer continuous edges 13 and 14 and pivotally mounted at its rear terminal end about an axle 15 that is common to pivotment of the commode seat 11 relative to the commode lid 12. The child's insert seat 17 includes a continuous outer edge 17 positioned between the commode's inner and outer edges 13 and 14, with an inner edge 18 positioned interiorly of the commode seat inner edge 13. A central tubular conduit 19 projects downwardly from the seat inner edge 18, with the seat 16 further including a hinge plate 20 with axle ears 21 orthogonally oriented relative to a rear edge of the hinge plate 20 for securement about the axle 15. Thusly, an elliptical opening 22 is defined interiorly of the insert seat's inner edge 18. A forward end 23 of the seat 16 includes a plurality of seat apertures 24 that are diametrically opposed to the hinge plate 20 to mount a urine deflector shield 25. The shield 25 includes a plurality of mounting legs 27 fixedly and orthogonally mounted to a planar bottom wall 28 of the shield 25. A vertical wall 29 extends above the bottom wall 28 and defines a convex deflector cavity 30 in confrontation with the elliptical opening 22 defined by an "S" shaped interior cavity wall 31 that extends below the bottom wall 28 to direct fluid spray from an infant or young child.

Figure 7:
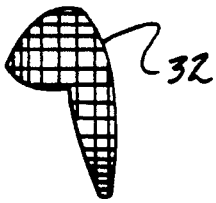
FIG. 7 is an isometric side view of a first splash shield sock member utilized.
Figure 10:
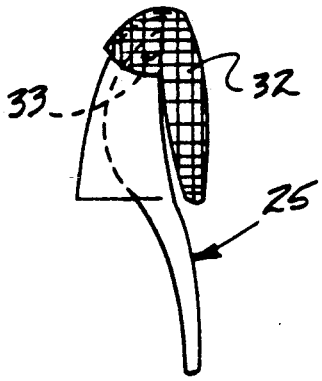
FIG. 10 is an orthographic side view illustrating the sock member structure mounted to the splash shield.
Figure 8:
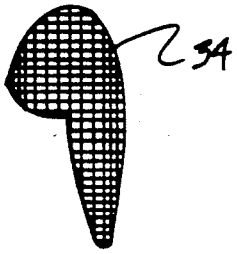
FIG. 8 is an orthographic side view of a second splash shield member utilized.
Figure 9:
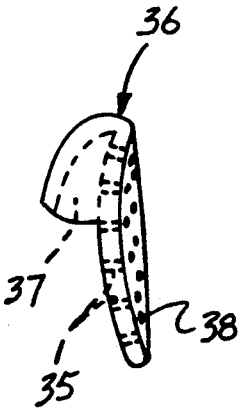
FIG. 9 is an orthographic side view of a splash plate utilized in association With a splash shield.
Figure 11:
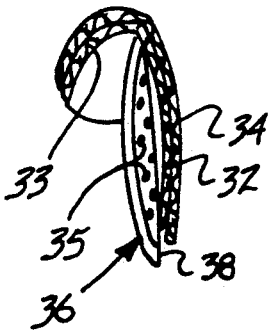
FIG. 11 is an orthographic side view of the splash shield and sock members utilized in a single assemblage for securement and positioning upon the associated splash shield.

FIG. 7 illustrates the use of a course mesh antisplash sock covering 32 to be mounted upon an upper end of the vertical wall 29 of the shield 25. Further, a fine mesh sock covering 34 is also provided. Each sock covering includes a shield receiving cavity 33 to receive the upper end of the vertical wall 29 therewithin, and includes a downwardly extending curtain to overlie the "S" shaped interior cavity wall 31. The course mesh socks, when utilized in concert as illustrated in FIG. 11, provide for a layered webbing structure to not only absorb, but minimize deflection of a fluid spray directed at the convex deflector cavity 30 of the shield 25. Further, a splash plate 36 (see FIG. 9) including a downwardly extending wall 38 including a matrix of apertures 35 is provided and formed with a splash plate cavity 37 for mounting upon the upper end portion of the vertical wall of the shield 25 as provided. The apertures are further provided conduits to direct and minimize a splashing effect. In use, the splash plate 36 is mounted upon the upper end portion of the vertical wall 29, with the course, then fine mesh sock member mounted in subsequent layers.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A child commode seat apparatus, comprising, a commode, the commode including a commode top surface, including an inner continuous edge spaced interiorly of an outer continuous edge, and a commode seat mounted upon the top surface, the commode seat pivotally mounted about an axle, the axle mounted upon a rear end portion of the top surface, and a child insert seat pivotally mounted to the axle interiorly of the commode seat, the insert seat including a seat inner edge positioned interiorly of the inner continuous edge, and a seat outer edge positioned between the inner continuous edge and the outer continuous edge, and the inner seat including a central tubular conduit projecting downwardly from the inner edge, and the inner edge defining an elliptical central opening, and a forward end of the insert seat diametrically spaced from the axle and includes a plurality of seat apertures, and a urine deflector shield selectively mounted to the forward end, wherein the shield includes a planar bottom wall, the planar bottom wall including a plurality of mounting legs, the plurality of mounting legs selectively received within the seat apertures, and the shield includes a vertical wall extending above the planar bottom wall, wherein the vertical wall includes a convex deflector cavity in confrontation with the central opening, the deflector cavity including an "S" shaped interior cavity wall extending below the planar bottom wall of the shield, the vertical wall including a vertical wall upper end spaced above the planar bottom wall, and a splash plate, the splash plate including an apertured splash wall complementarily received forwardly of the vertical wall and within the convex deflector cavity, the splash plate wall including a matrix of apertures directed therethrough, and the splash plate further including a splash plate cavity formed at an upper terminal end of the splash plate to receive the vertical wall upper end therewithin.

2. An apparatus as set forth in claim 1 including a first sock member formed of a course mesh flexible weave defining a shield receiving cavity receiving the upper end portion of the splash plate therewithin, and a fine mesh woven flexible sock covering positionable over the course mesh sock covering, wherein the course mesh sock covering, the fine mesh sock covering, and the splash plate wall are positioned coextensively and complementarily relative to the convex deflector cavity of the shield.

* * * * *